United States Patent [19]

Watelet

[11] 4,265,564

[45] May 5, 1981

[54] SLUICE GATE ASSEMBLY

[75] Inventor: Robert P. Watelet, Greenfield, Mass.

[73] Assignee: Rodney Hunt Company, Orange, Mass.

[21] Appl. No.: 87,654

[22] Filed: Oct. 24, 1979

[51] Int. Cl.[3] ..... E02B 7/28

[52] U.S. Cl. ..... 405/105

[58] Field of Search ..... 405/103, 104, 105, 106; 251/193, 203

[56] References Cited

U.S. PATENT DOCUMENTS

| | | | |
|---|---|---|---|
| 1,663,406 | 3/1928 | Holmes et al. | 405/105 |
| 2,229,629 | 1/1941 | Anderson | 405/104 |
| 2,643,521 | 6/1953 | Hatch | 405/106 |
| 2,697,913 | 12/1954 | Bonander et al. | 405/105 |
| 4,070,863 | 1/1978 | Brown | 405/105 |

FOREIGN PATENT DOCUMENTS

| | | | |
|---|---|---|---|
| 685012 | 12/1952 | United Kingdom | 405/104 |

*Primary Examiner*—David H. Corbin

*Attorney, Agent, or Firm*—Thompson, Birch, Gauthier & Samuels

[57] ABSTRACT

A sluice gate assembly has a metal frame surrounding an opening and a metal gate disc mounted for movement between open and closed positions along guides on the frame. The gate disc carries a resilient deformable seal which cooperates in sealing engagement with a plastic seat face on the frame when the gate disc is in the closed position. The sealing interface between the resilient deformable seal and the plastic seat face is arranged at an angle relative to the line of travel of the gate disc along the guides, and the guides are mounted for adjustable movement towards and away from the frame seat face.

6 Claims, 5 Drawing Figures

SLUICE GATE ASSEMBLY

BACKGROUND OF THE INVENTION

This invention relates generally to sluice gates of the type used in water control and sewage systems.

In one type of conventional sluice gate, for example that disclosed in U.S. Pat. No. 2,643,521 and British Pat. No. 685,012, a metal frame surrounds an opening and a metal gate disc is mounted on the frame for movement between open and closed positions. The gate disc and the frame have metal seat facings. Wedges on the gate disc cooperate with bosses on the frame to force the seat facings of the gate disc against the seat facings of the frame as the gate disc moves into the closed position. Although this type of sluice gate is entirely acceptable for a wide range of applications, experience has indicated that some leakage must be expected because dirt and grit will become trapped between the metal seat facings, and also because it is often difficult to achieve or maintain an optimum setting of the wedges relative to their associated bosses.

A number of attempts have been made at solving this leakage problem. For example, in U.S. Pat. No. 3,237,915, the gate disc is moved into and out of sealing engagement with a seat facing on the frame by means of a system of bell cranks pivotally responsive to vertical adjustment of the gate disc. This type of arrangement has failed to gain widespread acceptance, due in large part to the high costs and maintenance difficulties associated with the complicated crank-type closure mechanism.

Another attempted solution to the leakage problem is disclosed in U.S. Pat. No. 4,070,863 where the gate disc is provided with a seal which is extruded into sealing engagement with a metal seat facing on the frame. This extrusion is achieved by means of a seal retainer which surrounds the seal and which carries wedges arranged to cooperate with bosses on the frame. This arrangement also suffers from a relatively complicated and expensive construction.

In another known sluice gate assembly, a metal frame surrounds an opening and a metal gate disc is mounted for movement between open and closed positions along fixed guides on the frame. The gate disc carries a resilient deformable seal which cooperates in sealing engagement with a plastic seat face on the frame. The sealing interface between the two seal components is arranged at an angle relative to the line of travel of the gate disc so that as the gate disc slides along the guides into the closed position, the seal components are gradually brought together to affect a substantially leakproof seal. While this arrangement represents a decided improvement over prior attempts at eliminating or at least minimizing leakage, still certain problems remain. For example, because the guides are fixed relative to the frame, the degree of deformation of the seal on the gate disc is not adjustable. Thus, as wear occurs, or in the event that the deformable seal takes on a "set", leakage will result, thereby necessitating replacement of the deformable seal. Such replacements entail dismantling and reassembly of the sluice gate in the field. The objective of the present invention is to avoid this problem by providing a simple yet effective means for adjusting the degree of seal deformation without dismantling the sluice gate assembly. Such adjustments may be performed by the manufacturer during initial assembly of the sluice gate components, and by the user under field conditions without taking the gate out of service.

DESCRIPTION OF PREFERRED EMBODIMENT

Figure 1:
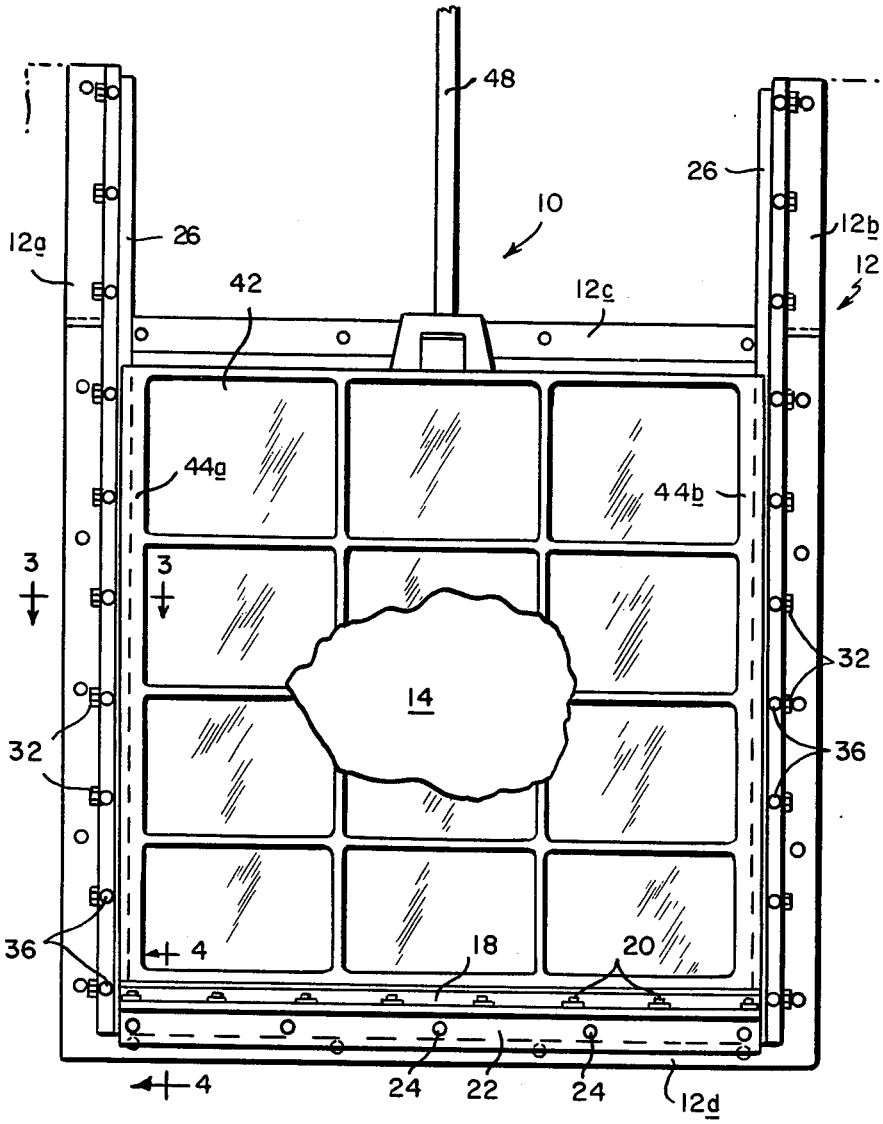
FIG. 1 is a front elevational view of a sluice gate embodying the concepts of the present invention, with a portion of the gate disc broken away.
Figure 2:
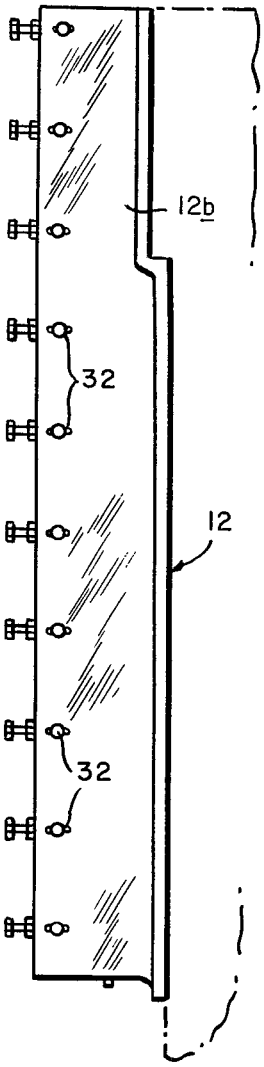
FIG. 2 is a side elevational view of the sluice gate shown in FIG. 1.

Referring to the drawings, a sluice gate assembly 10 is shown comprising a frame 12 surrounding an opening 14. The frame consists of side members 12*a*, 12*b* rigidly interconnected by horizontally extending top and bottom members 12*c*, 12*d*. The frame has a first seat facing which consists of a flat plastic strip 16 secured to the side members 12*a*, 12*b* and the top member 12*c*. Preferably, the material of strip 16 is polyvinylchloride and the strip is secured by means of conventionally available adhesives. To assist in securing the strip, it may be provided with integral pins 18 received in appropriately drilled holes in the frame.

A bottom neoprene seal 18 extends across the bottom frame member 12*d*. Seal 18 is secured by means of bolts 20 to a stop bar 22 which is in turn secured to bottom frame member 12*d* by means of bolts 24.

The frame side members 12*a*, 12*b* carry opposed vertically extending guide bars 26. The guide bars are supported on bolts 28 which extend through openings 30 in the frame side members. As can be best seen in FIG. 3, the openings 30 are elongated in a direction transverse to the lengths of the bar members 26. Nuts 32 cooperate with the support bolts 28 to fix the guide bars 26 in place on the frame side members.

Threaded holes 34 are in communication with and extend transversely relative to each opening 30. The holes 34 threadedly receive adjusting bolts 36. The inner ends of bolts 36 bear against the support bolts 28 as at 38. Lock nuts 40 fix the adjusting bolts 36 at any desired setting.

A gate disc 42 has side members 44*a*, 44*b*, each having an exteriorily facing groove 46 into which is received one of the guide bars 26. The guide bars 26 define a vertical path along which the gate 42 may be shifted between open and closed positions by any convenient means (not shown) connected to the gate stem 48.

Figure 3:
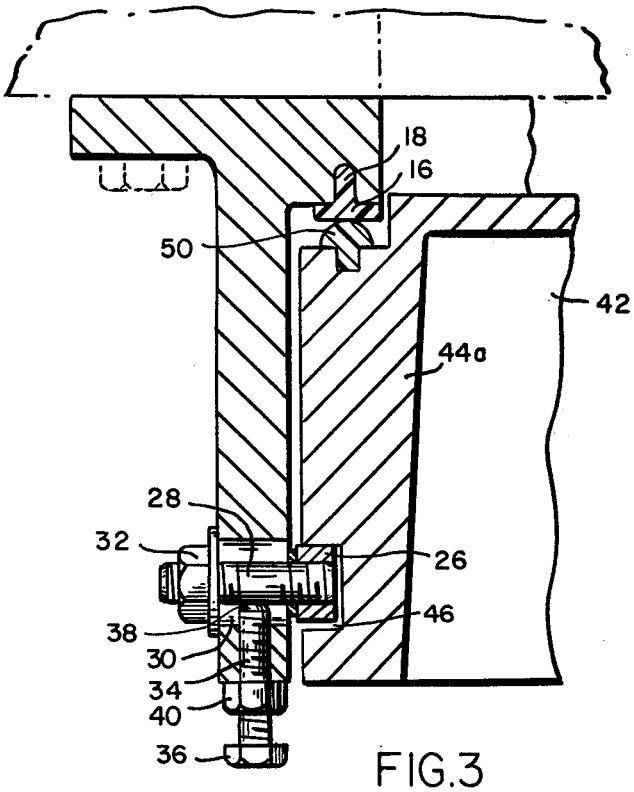
FIGS. 3 and 4 are sectional views taken respectively along lines 3—3 and 4—4 of FIG. 1; and, FIG. 5 is a vertical sectional view taken along lines 5—5 of FIG. 1 with the gate disc partially cut away and shown prior to its arrival at the fully closed position.
Figure 4:
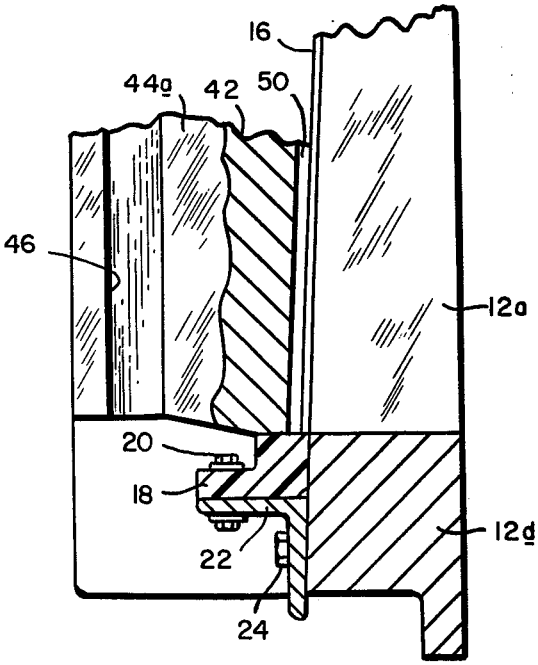
Figure 5:
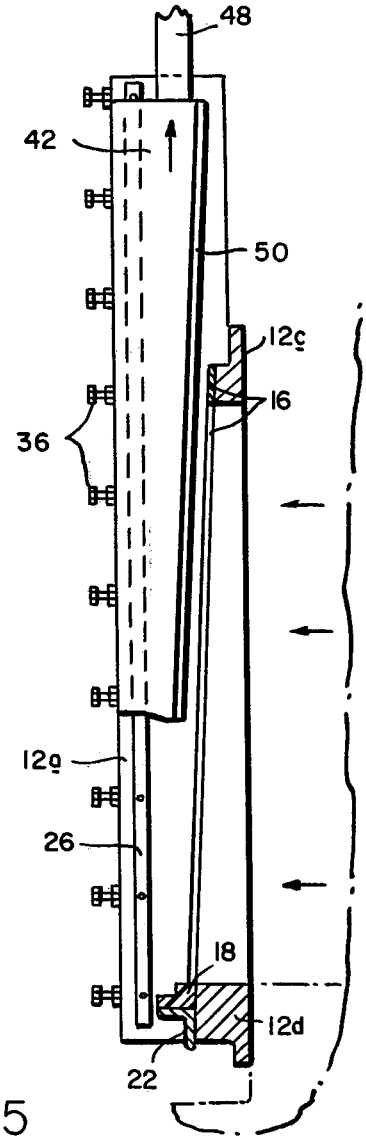

The gate disc 42 has second seat facing 50 arranged to cooperate in sealing engagement with the first seat facing 16 on the frame when the gate is in the closed position as shown for example in FIGS. 1–4. With reference to FIG. 5, it will be understood that the first and second seat facings 16, 50 are contained in planes which are parallel to each other and which are arranged at an angle relative to the path of movement of the gate disc 42 along the guide bars 26. This angle is such that the second seat facing 50 will move away from the first seat facing 16 during movement of the gate disc upwardly to the open position. Conversely, as the gate disc moves downwardly into the closed position, the second seat facing 50 will move towards the first seat facing 16 until it arrives in sealing engagement therewith as shown in FIG. 3. Preferably, the second seat facing 50 will consist of a resiliently deformable material such as for example neoprene.

The adjusting bolts 36 act as stops against which the support bolts 28 are supported. By adjusting the penetration of the bolts 36 into the openings 30, it is thus possible to adjust or vary the spacing between the guide bars 26 and the plane containing the first seat facing 16. To do this, the nuts 32 and 40 are first loosened and the bolts 36 are turned to achieve the proper adjustment. Proper adjustment is dictated by optimum cooperative sealing engagement between the first and second seat facings 16, 50 when the gate disc 42 is in the closed position. Once this adjustment has been made, nuts 32 are tightened to secure the guide bars 26 in place, and lock nuts 40 are tightened to fix the adjustment bolts 36 in place.

The adjustability of the guide bars 26 in relation to the first seat facing 16 offers several important advantages. For example, during initial assembly of the sluice gate components, the positions of the guide bars 26 can be adjusted to obtain optimum sealing between the opposed seat facings 16, 50. Thereafter, the guide bars can undergo further adjustments to compensate for wear or distortion of the seat facings. These subsequent adjustments, which can be made in the field will prolong the useful life of the seat facings.

It is my intention to cover all changes and modifications of the invention herein chosen for purposes of disclosure which do not depart from the spirit and scope of the claims appended hereto.

I claim:

1. A sluice gate assembly having a frame surrounding an opening and a gate disc mounted on the frame for movement between an open position permitting fluid flow through said opening and a closed position obstructing said fluid flow, said frame and gate disc having seat facings which are arranged in parallel planes and which cooperate in sealing engagement when the gate disc is in the closed position, said planes being arranged at an angle relative to the path of movement of said gate disc, and adjustment means for shifting the path of movement of said gate disc relative to the seat facing of said frame.

2. A sluice gate assembly comprising: a frame surrounding an opening, said frame having relatively spaced guides and a first seat facing; a gate disc mounted on said guides for movement between open and closed positions, said gate disc having a second seat facing cooperating in sealing engagement with said first seat facing when the gate disc is in the closed position, said first and second seat facings being contained in planes which are parallel to each other and arranged at an angle relative to the path of movement of said gate disc along said guides, the said angle being such that said second seat facing will move away from said first seat facing during movement of said gate disc towards the open position and towards said first seat facing during movement of said gate disc towards the closed position; and, adjustment means for varying the spacing between said guides and said first seat facing.

3. The sluice gate assembly of claim 2 wherein at least one of said seat facings is comprised of a resiliently deformable material.

4. The sluice gate assembly of claim 2 wherein said guides comprise bar members received in grooves in the sides of said gate disc.

5. The sluice gate assembly of claim 4 wherein said bar members are supported on bolts extending laterally through openings in said frame, said openings being elongated in a direction transverse to the lengths of said bar members.

6. The sluice gate assembly of claim 5 wherein said adjustment means includes threaded holes communicating with said openings and extending in the direction of elongation thereof through said frame, and bolts threaded through said holes, said bolts providing adjustable stops for the bolts supporting said bar members.

* * * * *